United States Patent [19]

Triplett et al.

[11] 4,290,498

[45] Sep. 22, 1981

[54] ABLATIBLE DRILL

[76] Inventors: William C. Triplett, 3154 Reid Dr., Corpus Christi, Tex. 78404; Walter H. Brauer, 3725 Wakeforest, Houston, Tex. 77098

[21] Appl. No.: 29,031

[22] Filed: Apr. 11, 1979

[51] Int. Cl.[3] ..... E21B 10/60

[52] U.S. Cl. ..... 175/379; 175/42; 175/39; 175/409; 175/393; 408/16; 408/59; 408/145

[58] Field of Search ..... 175/39, 42, 307, 320, 175/329, 330, 379, 409, 410, 393, 406, 412; 408/16, 59, 145, 224, 225, 703, 210, 204–206

[56] References Cited

U.S. PATENT DOCUMENTS

| | | | |
|---|---|---|---|
| 1,057,922 | 4/1913 | Blackburn | 175/330 |
| 1,089,525 | 3/1914 | Bignell | 175/393 X |
| 1,471,526 | 10/1923 | Pickin | 175/409 X |
| 1,505,460 | 8/1924 | Griesche | 175/379 |
| 1,519,135 | 12/1924 | Hansen | 175/379 |
| 1,572,349 | 2/1926 | Chamberlin | 175/409 |
| 1,621,232 | 3/1927 | Bignell | 175/393 X |
| 2,203,747 | 6/1940 | Sandstone | 175/379 |
| 2,234,273 | 3/1941 | Pennington | 175/379 X |
| 2,280,851 | 4/1942 | Ranney | 175/329 X |
| 2,468,905 | 5/1949 | Warren, Jr. | 175/39 |
| 2,511,831 | 6/1950 | Adamson | 175/329 X |
| 3,015,360 | 1/1962 | Stratton | 175/7 X |
| 4,030,558 | 6/1977 | Morris | 175/39 |

FOREIGN PATENT DOCUMENTS

| | | | |
|---|---|---|---|
| 781314 | 2/1935 | France | 175/409 |
| 618525 | 8/1978 | U.S.S.R. | 175/39 |

*Primary Examiner*—Richard E. Favreau

[57] ABSTRACT

There is disclosed an ablatible drill comprising a soft or frangible matrix having embedded therein a multiplicity of hard inclusions which act as cutting teeth. During drilling, the matrix gradually wears away so that worn inclusions are circulated out of the hole and fresh inclusions are exposed as new cutting teeth. A plurality of joints of the ablatible drill are interconnected on the bottom of a drill string. The comminuted material of each joint of the ablatible drill provides a characteristic distinguishable from the comminuted material of adjacent joints so that in examination of the circulated returns provides an indication of which joint is then being drilled.

9 Claims, 7 Drawing Figures

ABLATIBLE DRILL

This invention relates to a new and useful bit for drilling bore holes in the earth.

One of the facts of life of drilling bore holes in the earth to substantial depths is that an inordinate amount of time is spent coming out of the hole with a worn bit and going back into the hole with a new bit. This is, of course, a more substantial problem in the drilling of deep holes through hard rock as opposed to the drilling of shallow holes through soft sediments.

It has been the aim of drill bit technology since the inception of the oil industry to provide bits which are capable of faster drilling and are capable of longer drilling times. The development has progressed from the original fishtail type bits through cone type bits having integral teeth thereon to the present cone type bits having buttons thereon of tungsten carbide or other hard material. Despite the fact that tungsten carbide buttons are extremely hard and that cone bearings have been substantially improved over the years, the useful life of bits in many drilling situations is measured on the order of a few hours or a few tens of feet. Accordingly, in many situations it would not be unusual to spend more time making trips to replace worn bits than is expended during actual drilling. Even in situations which are not inordinately aggravated, a substantial part of the time spent in drilling a well is consumed by tripping the drill string to replace worn bits.

One approach that has been pursued to some extent to reduce trip time is to design the bit so that it can be withdrawn through the drill string, either hydraulically or by a wire line. Although this approach may be meritorious, it has not replaced the conventional drill bit.

Another approach which has broadly been suggested in the prior art is to provide a drill bit which is ablatible or self renewing. In devices of this type, the lower portion of the bit wears away because of contact with the face of the bore hole to expose fresh cutting elements. Devices of this type are disclosed in U.S. Pat. Nos. 1,505,460; 1,676,887; 2,830,795; 2,833,520; 2,966,949; 3,295,617 and 3,495,359. Other disclosures of more general interest are found in the U.S. Pat. Nos. 1,519,135; 2,121,202; 2,371,488; 2,493,178; 2,838,284 and 3,848,687.

It is apparent that, among other drawbacks, the self renewing capabilities of the prior art ablatible drills is limited because of the limited axial extent of the bit. As will be more fully pointed out hereinafter, one of the principal features of this invention is the provision of an ablatible drill comprising a plurality of interconnected joints which is of substantial vertical extent thereby further minimizing the need for tripping the drill string.

In summary, the ablatible drill of this invention comprises a matrix of relatively soft or relatively frangible material and which has embedded therein a multiplicity of hard inclusions which act as drill teeth. The terms relatively soft and relatively frangible are intended to means soft and/or frangible relative to the inclusions and/or the drilled formation. The bit of this invention comprises a plurality of interconnected joints which are coupled to the bottom of a drill string. During drilling, the matrix is eroded at a rate commensurate with the wear on the hard inclusions to periodically release worn inclusions and expose fresh ones. The comminuted material of the ablatible drill, comprising particles of fragments of the matrix as well as the hard inclusions, is circulated up the hole along with formation cuttings by the circulation of a drilling fluid as is customary in rotary drilling.

It is desirable, of course, to be able to determine the approximate depth where one is drilling without having to trip the drill string. Although this may be accomplished by periodically dropping a sinker bar connected to a wire line inside the drill pipe to determine the exact depth of drilling, it is preferred that the material of each joint of the ablatible drill of this invention provide a distinguishing characteristic when compared to the material of adjacent joints. Accordingly, the approximate depth of drilling can be determined by examining the returned drilling fluid and/or cuttings to determine which joint is then being drilled.

It is an object of this invention to provide an improved ablatible drill.

Other objects and advantages of this invention will become more fully apparent as this description proceeds, reference being made to the accompanying drawings and appended claims.

IN THE DRAWINGS

Figure 1:
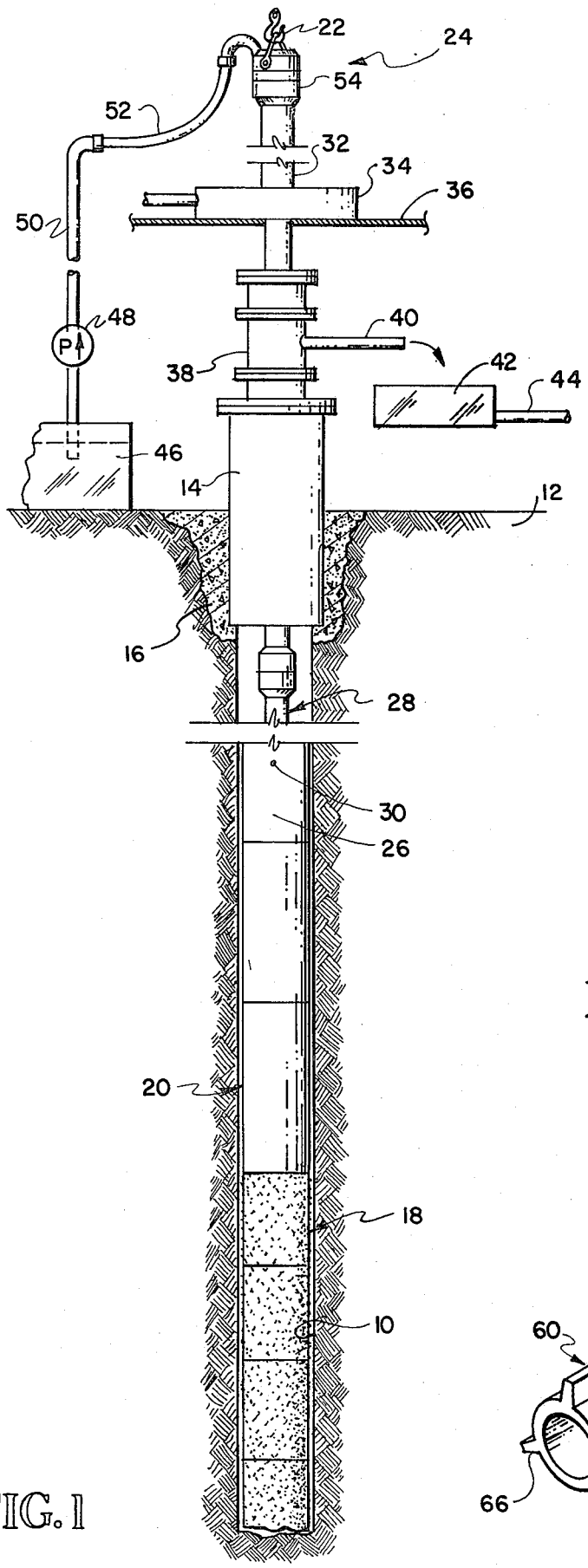
FIG. 1 is a partially schmatic view of a preferred embodiment of this invention.

Referring to FIG. 1, there is illustrated a bore hole 10 being drilled in the earth 12 through a string 14 of surface pipe placed therein and bonded to the earth by a cement sheath 16. The hole 10 is being drilled with an ablatible drill 18 of this invention carried on the bottom of a drill string 20 which is suspended from a hook 22 provided by a travelling block (not shown) of a suitable drilling rig 24.

The drill string 20 comprises the ablatible drill 18 of this invention, a multiplicity of drill collars 26 and a string of drill pipe 28 illustrated as including a number of pipe joints having externally upset box and pin screw thread connections. The functions of the drill string 20 are to conduct drilling fluid to the bit 18, to transmit torque to the bit 18, to stabilize the direction of drilling, to provide means for removing the bit 18 from the hole 10 and to apply weight to the bit 18. The general function of the drill pipe 28 is to provide a mechanical and hydraulic connection to the drill collars 26. The drill collars 26 provide a mechanical and hydraulic connection between the drill pipe 28 and the bit 18 and also act to apply weight to the bit 18 and to stabilize the direction of drilling. The drill collars 26 are typically massive pipe joints providing a substantial amount of weight immediately above the bit 18 and are as inflexible as practicalities allow.

One of the early lessons in drilling with rotary drill pipe is that the bulk of the drill string 20 must be kept in tension with only the lower part of the drill collars 26 allowed to be in compression in order to drill a relatively straight hole. Thus, the so-called neutral point 30 divides the drill string 20 into a relatively short lower section which is in compression and a relatively long upper section which is in tension.

The drill pipe 28 is connected to a kelly 32 extending through a rotary table 34 carried on the floor 36 of the drilling rig 24. The drill pipe 28 extends through a stack of connections 38 including a blow out preventer (not shown) and providing a mud return line 40 which typically empties into a shale shaker or solids remover 42 having a discharge outlet 44 delivering mud to a pit or tank 46. Drilling fluid from the tank 46 is typically delivered by a pump 48 through a conventional standpipe 50 and flexible mud hose 52 to a swivel 54 suspended from the hook 22. The swivel 54 is connected to the kelly 32 and acts to transfer pressurized drilling fluid to the kelly 32 and the drill string 20 and to suspend the drill string 20 from the hook 22.

Figure 2:
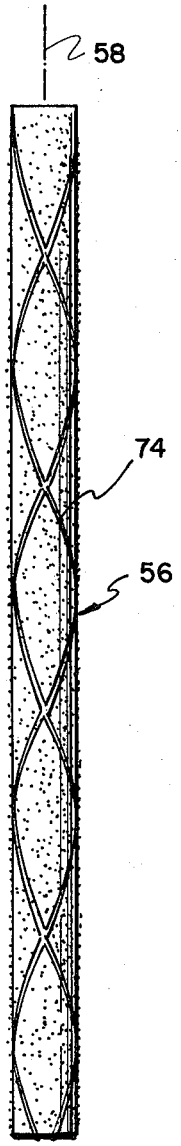
FIG. 2 is an enlarged side elevational view of one joint of the ablatible drill of FIG. 1.
Figure 3:
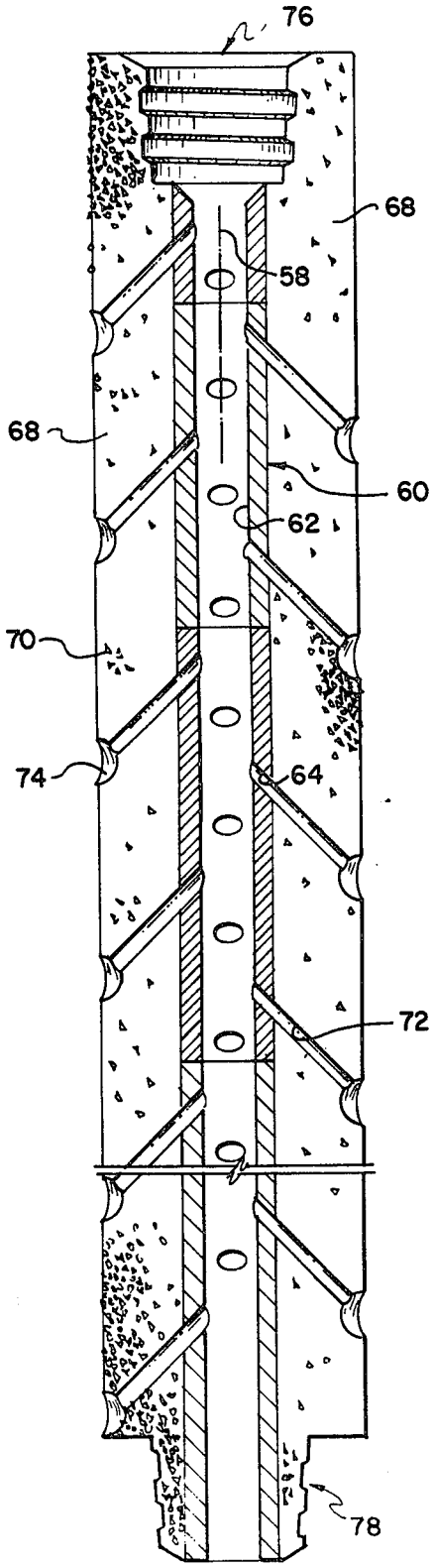
FIG. 3 is an enlarged longitudinal cross-sectional view of one joint of the ablatible drill of this invention.

Referring to FIGS. 2 and 3, one of the joints 56 of the ablatible drill 18 is illustrated in greater detail. Each of the joints 56 comprises an elongate body generally symmetrical about an axis 58 having a central tube 60 providing an axial passage 62 and a plurality of transverse passages 64 providing communication between the inner and outer portions of the tube 60. For reasons more fully pointed out hereinafter, the passages 64 are generally downwardly inclined relative to the bit axis 58. As shown best in FIG. 4, the central tube 60 provides a plurality of generally radially extending flanges or ribs 66 which assist in transmitting torque to the bottom of the bit 18.

Surrounded and bonded to the central tube 60 is an annular sleeve comprised of a relatively soft or frangible matrix 68 having embedded therein a multiplicity of hard inclusions 70 comprising the teeth of the bit 18. The annular sleeve provides a plurality of generally downwardly inclined passages 72 communicating with the passages 64 and opening into one of a plurality of generally helical grooves 74 provided in the exterior of the bit 18 as shown best in FIG. 2.

As is apparent from FIG. 3, the upper end of the joint 56 provides a female thread connection 76 while the lower end thereof provides a male thread connection 78.

The matrix 68 is selected from a group of materials which are either relatively soft or relatively frangible in order to periodically release worn inclusions 70 and expose fresh or unworn ones. Although many different types of materials appear practicable, presently preferred materials are selected from the group consisting of aluminum, aluminum alloys, cast iron, ceramics, organic polymers, cementation materials and composite mixture of same.

The inclusions 70 may vary widely in shape and in the selected material thereof. Suitable shapes include generally spherical, regular polyhedrons, irregular chips, or combinations thereof. Although the material of the inclusions 70 may vary considerably, the presently preferred material is tungsten carbide for apparent reasons. It will be evident, however, that diamond or other hard materials are satisfactory. It will be evident that the dispersion of the inclusions 70 in the matrix 68 may be either regular, random, or combinations thereof.

In order to manufacture the joint 56 of FIGS. 2 and 3, the central tube 60 is provided in a plurality of sections which are aligned in a mold with sand or other passage forming means used to provide the downwardly extending passages 72. The matrix forming material is liquified and the inclusions 70 added thereto to form a liquid mixture. This liquid mixture is delivered to the mold. The female and male threads 76, 78 are roughly cast into opposite ends of the joints 56 by use of a suitable mold part. In the event it is desired to dress the cast threads, the thread forming mold parts may be vibrated slightly to move the inclusions 70 away from the thread sections so that the threads can later be dressed by machining.

The method of manufacturing may be further improved by rotating the mold at selected speed about the central axis of the positioned central tube 60 thereby creating centrifugal forces within the liquid mixture. Because the inclusions are typically more dense than the matrix, the created centrifugal force cause an increased proportion of the inclusions to be located adjacent the periphery of the drill. This has two advantages. First, cutting action on the exterior of the drill is improved. Second, the exterior of the drill wears at a slower rate thereby decreasing the tendency of the drilled hole from becoming smaller and out of gauge toward the bottom of the hole.

Although some of the prior art ablatible drills appear to be of substantial axial length, one problem that apparently has not been addressed is how one determines, from the surface, the approximate depth at which drilling is being conducted. In drilling with conventional rotary bits, it is customary that the driller periodically measure the pipe while going in or coming out of the hole. In this fashion, the driller can compute the depth at which drilling is being conducted merely by summing the lengths of tallied pipe. Even if pipe were tallied as joints of drill pipe are added to the drill string 20 during drilling, one could not compute, at the surface, the approximate depth at which drilling is being conducted since the extent of wear of the ablatible bit 18 is unknown. It is apparent, of course, that a sinker bar attached to a wire line may be dropped through the drill string 20 and through the passage 62 of the bit 18 of this invention to locate the bottom of the hole 10. This technique has, of course, its attendent disadvantages.

In accordance with one feature of this invention, sections of each joint 56 or separate ones of the joints 56 provide a characteristic which is distinguishable from that of adjacent sections or joints. As the bit 18 is worn during drilling, comminuted particles or fragments of the different sections or joints may be analyzed at the surface by examining the solids collected by the shale shaker or solids remover 42. It will be apparent that a wide variety of techniques may be used to determine which section or joint is or has been consumed. By correlating this information with the known length of the bit 18 as it is run into the hole and the location of each of the differently coded sections or joints, computations may be conducted to reliably determine the bottom of the bit 18 and consequently the bottom of the bore hole 10.

It is evident that the material which provides the distinguishing characteristic may be part of the matrix 68, may comprise differently configured inclusions 70, may comprise inclusions 70 of different material or may comprise different materials in sections of the central tube 60.

Figure 4:
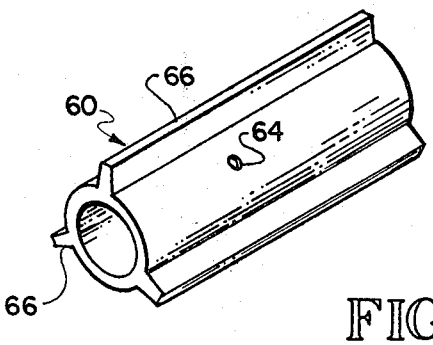
FIG. 4 is an isometric view of one of the central tube sections illustrated in FIG. 3.

One convenient technique is to fabricate the central tube 60 in sections, as suggested in FIG. 4, of different color so that fragments thereof appearing in the solids remover 42 may be inspected to determine the color of the section then being eroded. Although the length of the sections of different characteristics, such as the central tube sections illustrated in FIG. 4, may vary substantially, the length of each such section is preferably in the range of about 1–10 feet and is most desirably about 5 feet. Accordingly, the driller may compute, within an error of ±5 feet, the actual depth at which drilling is being conducted.

Because the embodiment of FIG. 2 includes four helical grooves 74, it will be apparent that the joint 56 is of a four lobe design.

Figure 5:
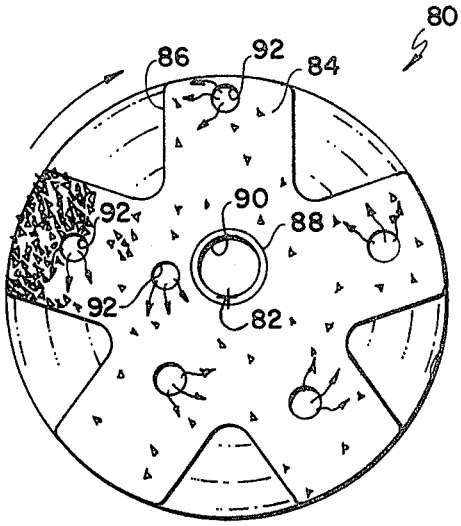
FIGS. 5–7 are end views of different embodiments of the ablatible drill of this invention illustrating various shapes thereof.

Referring to FIG. 5, there is illustrated a five lobe embodiment 80 of the ablatible drill of this invention. The drill 80 includes a central axis 82 and five lobes 84 projecting generally radially therefrom. Defined between the lobes 84 are five helical grooves 86 allowing the removal of cuttings, bit fragments and the like. The bit 80 provides a central tube 88 having a passage 90 therethrough for conveying drilling fluids to the bottom of the bit 80. The tube 88 is offset relative to the axis 82 to prevent a core from being formed inside the passage 90. A plurality of additional mud passages 92 extend longitudinally through the bit 80 and open into the central passage 90 immediately below the female thread connection at the top of the joint.

Figure 6:
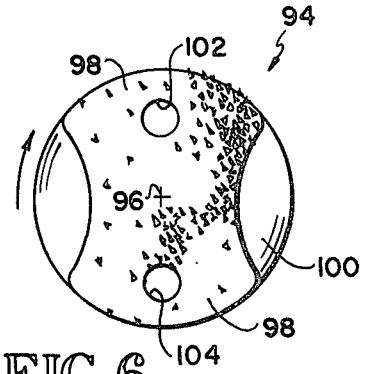

Referring to FIG. 6, there is illustrated a two lobe embodiment 94 having a central axis 96 and a pair of lobes 98 which define therebetween a pair of generally helical grooves 100. Rather than provide a central tube as in the embodiments of FIGS. 3 and 5, the drill 94 provides a pair of longitudinally extending passages 102, 104 which converge adjacent the female thread coupling at the upper end of the joint.

Figure 7:
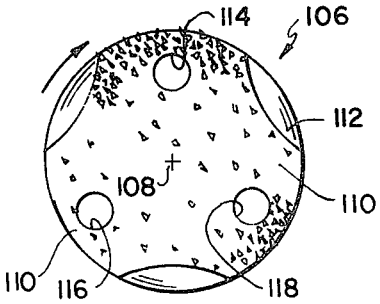

Referring to FIG. 7, there is illustrated a three-lobe embodiment 106 of the ablatible drill of this invention comprising a tool axis 108 from which project three drilling lobes 110 defining therebetween three generally helical grooves 112. Three longitudinally extending passages 114, 116, 118 extending longitudinally through the joint and converge immediately below the female thread coupling at the upper end thereof. Because the passages 114, 116, 118 are spaced the tool axis 108, no core will be formed.

The length of the ablatible drill that is affixed to the bottom of the drill collar string may vary depending on the depth of the hole to be drilled, the stiffness of the drill 18 and the like. Under some circumstances, it may be desirable to run sufficient numbers of joints 56 which will allow the entire hole to be drilled without tripping the drill string 20. Under other circumstances, it may be desirable to plan on tripping the drill string to add new joints of the ablatible drill of this invention.

The length of each joint of the ablatible drill of this invention may also vary substantially. It would appear, prima facie, that the joints should be of a maximum convenient length to minimize the number of tool joint connections. There is, however, a countervailing consideration. It seems clear that the joints 56 will not be as stiff as the drill collars 26. This is, of course, a disadvantage since it is desirable that the lower end of the drill string 20 be as stiff as practicalities allow. One technique for stiffing a section of a tubular string is to use a larger number of relatively short joints rather than a fewer number of relatively long joints. Accordingly, under some circumstances, it may be desirable that the joints 56 are of substantially shorter length than 30 feet which is the customary nominal length of drill pipe and drill collars. It is not exactly clear why this technique stiffens a tubular string although it would seen to indicate that the tool joint is stiffer than the tool body.

Although the invention has been described in its preferred forms which a certain degree of particularity, it is understood that the present disclosure of the preferred form is only by way of example and that numerous changes in the details in construction and the combination and arrangement of parts may be resorted to without departing from the spirit and scope of the invention as hereinafter claimed.

I claim:

1. A drill string comprising a string of drill pipe having a plurality of drill collars on the lower end thereof; and a bit, having a multiplicity of cutting elements, connected with the lowermost drill collar and comprising a plurality of interconnected joints defining a vertical axis, each joint including a matrix having therein a multiplicity of inclusions substantially harder than the matrix, the inclusions being distributed throughout the matrix from adjacent the axis to adjacent the periphery of each joint, the inclusions comprising the cutting elements.

2. The drill string of claim 1 wherein comminuted material of a first section of the drill provides a characteristic distinguishable from comminuted material of a second axially spaced section of the drill.

3. The drill string of claim 1 wherein each joint comprises a plurality of communicating tube sections providing a flow passage for drilling fluid, comminuted materials of each tube section providing a characteristic distinguishable from comminuted material of adjacent tube sections.

4. The drill string of claim 1 wherein comminuted material of a first joint provides a characteristic distinguishable from comminuted material of a second joint.

5. The drill string of claim 4 wherein each joint comprises a central tube of a material different from the matrix, comminuted material of the tube of the first joint being distinguishable from comminuted material of the second joint.

6. The drill string of claim 1 wherein the bit comprises a terminal joint and an adjacent joint, the terminal and adjacent joints providing therebetween a connection for securing the joints together in load transmitting relation.

7. The drill string of claim 6 wherein the connection comprises a screw connection comprised of a matrix having therein a multiplicity of inclusions substantially harder than the matrix, the inclusions being distributed throughout the matrix from adjacent the axis to adjacent the periphery of each screw connection.

8. The drill string of claim 6 wherein comminuted material of a first section of a first joint provides a characteristic distinguishable from comminuted material of a second axially spaced section of the first joint.

9. A bit having a multiplicity of cutting elements and comprising a plurality of interconnected joints defining a vertical axis, each joint including a matrix having therein a multiplicity of inclusions substantially harder than the matrix, the inclusions being distributed throughout the matrix from adjacent the axis to adjacent the periphery of each joint, the inclusions comprising the cutting elements; and means for rotating the bit.

* * * * *